US012552512B2

(12) United States Patent
Uggeri et al.

(10) Patent No.: US 12,552,512 B2
(45) Date of Patent: Feb. 17, 2026

(54) PROPELLER ASSEMBLY FOR A BOAT

(71) Applicant: MasterCraft Boat Company, LLC, Vonore, TN (US)

(72) Inventors: Michael J. Uggeri, Knoxville, TN (US); Richard Lee Best, Maryville, TN (US)

(73) Assignee: MasterCraft Boat Company, LLC, Vonore, TN (US)

( * ) Notice: Subject to any disclaimer, the term of this patent is extended or adjusted under 35 U.S.C. 154(b) by 712 days.

(21) Appl. No.: 17/893,374

(22) Filed: Aug. 23, 2022

(65) Prior Publication Data

US 2023/0067869 A1 Mar. 2, 2023

Related U.S. Application Data

(60) Provisional application No. 63/236,308, filed on Aug. 24, 2021.

(51) Int. Cl.
*B63H 23/32* (2006.01)
*B63H 1/14* (2006.01)
*B63H 23/34* (2006.01)

(52) U.S. Cl.
CPC ..... *B63H 23/321* (2013.01); *B63H 1/14* (2013.01); *B63H 23/34* (2013.01); *B63H 2023/325* (2013.01)

(58) Field of Classification Search
CPC ..... B63H 23/00; B63H 23/32; B63H 23/321; B63H 2023/325; B63H 1/00; B63H 1/14; B63H 1/20
USPC ..... 440/79, 81, 83; 114/79, 81, 83
See application file for complete search history.

(56) References Cited

U.S. PATENT DOCUMENTS 4,027,613 A * 6/1977 Wollard ..... B63B 1/18 114/291
4,655,157 A * 4/1987 Sapp ..... B63B 1/18 114/291
5,697,821 A 12/1997 Ogino
6,193,572 B1 * 2/2001 Neisen ..... B63H 23/321 440/49
6,383,042 B1 5/2002 Neisen
6,585,546 B2 7/2003 Higby et al.
6,609,892 B1 8/2003 Kreul et al.
(Continued)

OTHER PUBLICATIONS

Hub Kits—Quicksilver Products, Mercury Marine, https://www.quicksilver-products.com/marine/propellers/hub-kits/ (accessed Aug. 31, 2021).

*Primary Examiner* — Daniel V Venne
(74) *Attorney, Agent, or Firm* — Venable LLP

(57) ABSTRACT

A boat and a propeller assembly for a boat. The propeller assembly includes a propeller and a thrust bearing, and the thrust bearing is made of a harder material than the propeller. The boat may also include a hull, a drive shaft, and a motor. The motor may be positioned within the hull and configured to rotate the drive shaft. The drive shaft may extend through a hull bottom of the hull and the propeller assembly may be positioned forward of a transom of the hull and beneath the hull bottom. The propeller may include a central hub having a hole capable of having the drive shaft inserted therethrough. The thrust bearing may be located in the hole of the central hub and secured to the propeller such that the thrust bearing and the propeller form a unified assembly.

20 Claims, 6 Drawing Sheets

(56) References Cited

U.S. PATENT DOCUMENTS

| | | | |
|---|---|---|---|
| 10,494,070 | B2 | 12/2019 | McKinny, Jr. |
| 10,967,948 | B2 | 4/2021 | Onoue et al. |
| 2017/0210456 | A1 | 7/2017 | Lin |

* cited by examiner

PROPELLER ASSEMBLY FOR A BOAT

CROSS-REFERENCE TO RELATED APPLICATIONS

This application claims the benefit under 35 U.S.C. § 119(e) of U.S. Provisional Patent Application No. 63/236,308, filed Aug. 24, 2021, and titled "PROPELLER ASSEMBLY FOR A BOAT," the entirety of which is incorporated herein by reference.

FIELD OF THE INVENTION

The invention relates to a propeller assembly for a boat, particularly an inboard boat for water sports.

BACKGROUND OF THE INVENTION

Recreational boats may be propelled through the water by a propeller that is driven by an engine. In addition to cruising, recreational boats also may be used for other activities on the water, including water sports like water skiing, wakeboarding, wake surfing, and wake foiling. Such boats may be referred to as recreational sport boats. Under such usage, recreational sport boats often are used to tow water sports participants during water skiing and wakeboarding, and to tow water sports participants, at least at the beginning, during wake surfing and wake foiling. For wake surfing and wake foiling, the water sport participant is propelled forward by the wake produced by the boat. Water sports, such as water skiing and wakeboarding, are typically performed at high speeds, and many boats used for these sports have planing hulls, which are designed for efficient high-speed operation. In addition, many recreational sport boats are inboards, having a propeller positioned beneath the hull, forward of the transom. This configuration is generally safer for water sports, as compared to outboards or sterndrives, for example, where the propeller is located behind the transom of the boat.

SUMMARY OF THE INVENTION

In one aspect, the invention relates to a boat including a hull, a drive shaft, a motor, and a propeller assembly. The hull includes a transom and a hull bottom. The drive shaft extends through the hull bottom. The motor is positioned within the hull and configured to rotate the drive shaft. The propeller assembly is positioned forward of the transom and beneath the hull bottom. The propeller assembly includes a propeller and a thrust bearing. The propeller assembly is connected to the drive shaft such that rotation of the drive shaft rotates the propeller assembly. The thrust bearing is made of a harder material than the propeller.

In another aspect, the invention relates to a propeller assembly for a boat. The propeller assembly includes a propeller and a thrust bearing. The propeller includes a central hub and a plurality of blades connected to the central hub. The central hub includes a hole capable of having a drive shaft inserted therethrough. The thrust bearing is located in the hole of the central hub and secured to the propeller such that the thrust bearing and the propeller form a unified assembly. The thrust bearing is made of a harder material than the propeller.

These and other aspects of the invention will become apparent from the following disclosure.

DETAILED DESCRIPTION OF THE PREFERRED EMBODIMENTS

Figure 1:
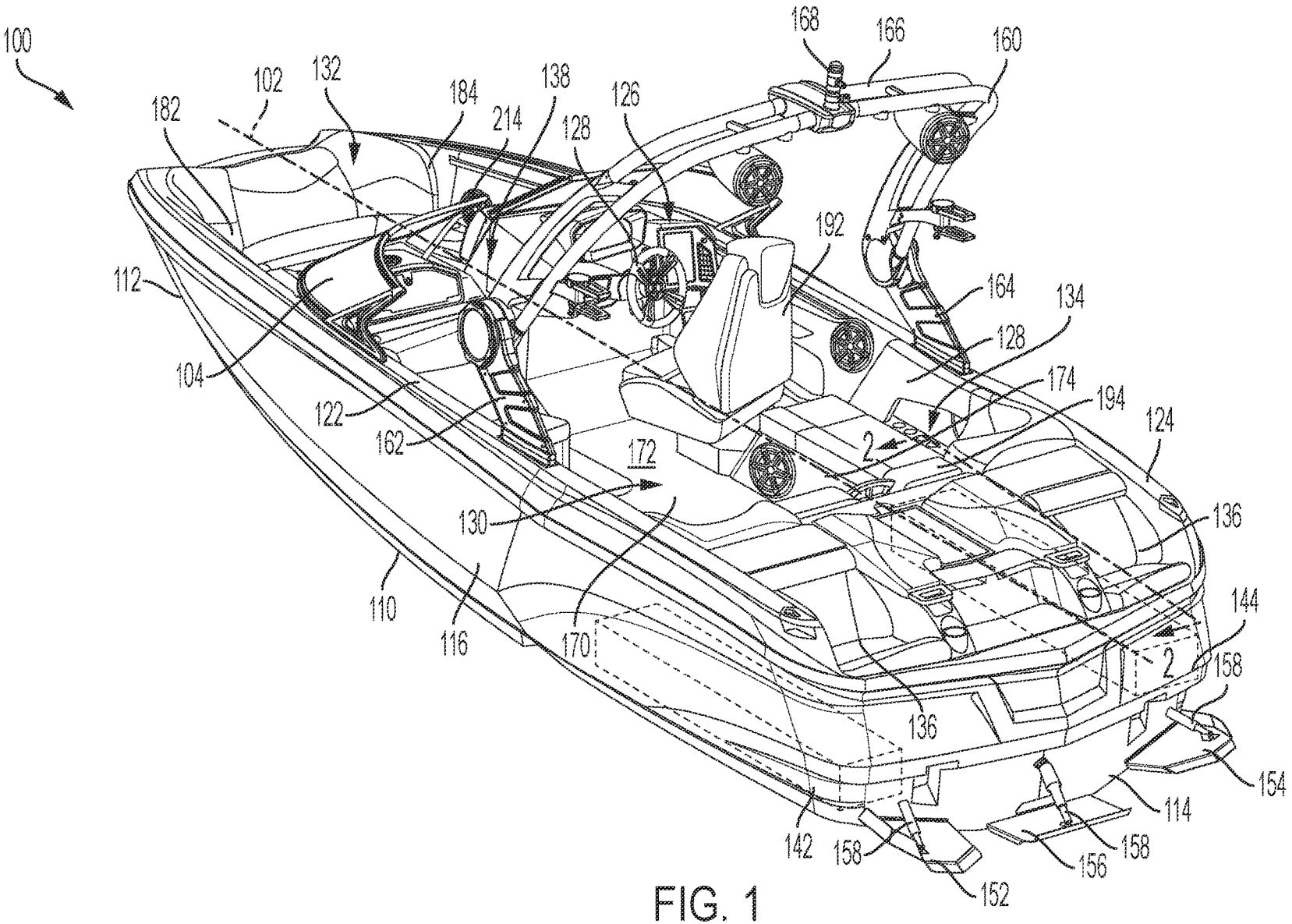
FIG. 1 shows a boat that may be equipped with a propeller assembly according to a preferred embodiment of the invention.

As used herein, directional terms forward (fore), aft, inboard, and outboard have their commonly understood meaning in the art. Relative to the boat, forward is a direction toward the bow and aft is a direction toward the stern. Likewise, inboard is a direction toward the center of the boat and outboard is a direction away from the center of the boat. FIG. 1 shows a boat 100 that may be equipped with a propeller assembly 300 in accordance with an exemplary preferred embodiment of the invention. The boat 100 includes a hull 110 with a bow 112, a transom 114, a port side 116, a starboard side 118, and a hull bottom 119 (see FIG. 2). The hull 110 is a planing hull. When planing hull boats reach a certain speed, the resistance of the hull dramatically drops as the boat is supported by hydrodynamic forces instead of hydrostatic (buoyant) forces. This is referred to as planing. Some characteristics of the hull 110 that are typical of planing hull boats include lifting strakes, a hard chine, and a deadrise from 0° to 30°.

The port and starboard sides 116, 118 have port and starboard gunwales 122, 124, respectively. The boat 100 has a centerline 102 running down the middle of the boat 100, halfway between the port and starboard sides 116, 118. Collectively, the bow 112, the transom 114, and the port and starboard sides 116, 118 define an interior 130 of the boat 100.

In the embodiment shown in FIG. 1, the boat 100 is a bowrider having both a bow seating area 132 positioned in the bow 112 of the boat 100 and a primary seating area 134 (sometimes also referred to as the cockpit) positioned aft of a windshield 104. The boat 100 shown in FIGS. 1 and 2 also has a pair of aft-facing seats 136, such as those described in U.S. Pat. No. 9,650,117, which is incorporated by reference herein in its entirety. Also within the boat's interior 130 is a control console 126 for operating the boat 100. Here, the control console 126 is positioned on the starboard side of the boat 100 proximate to and aft of the windshield 104. Although described in reference to a bowrider, this invention may be used with any suitable boat including cuddies, center consoles, and cruisers, for example. Also, the invention is not limited to boats with single decks and can be used with other boats that have multiple decks, such as a flybridge.

Figure 2:
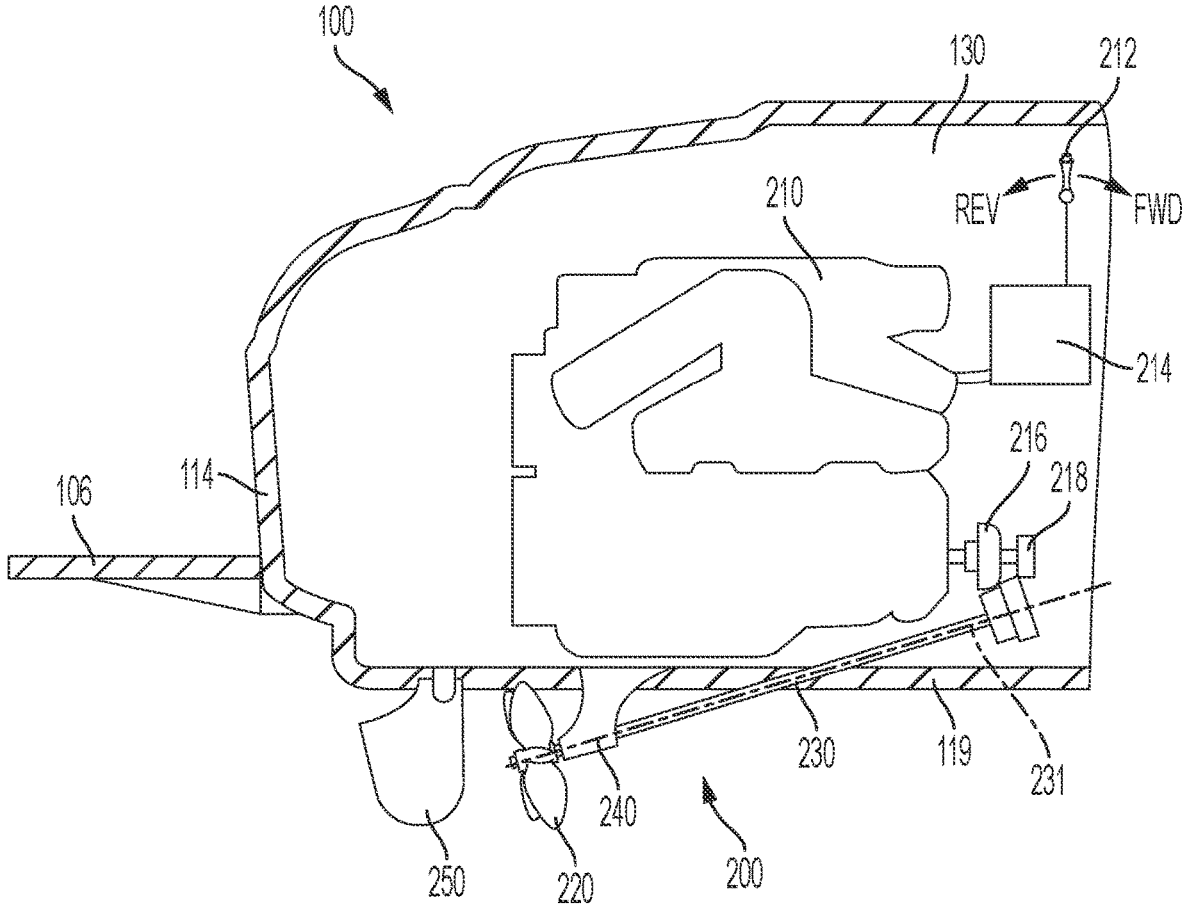
FIG. 2 is a cross-sectional view, taken along line 2-2 in FIG. 1, of a stern of the boat shown in FIG. 1.

As shown in FIG. 2, the boat 100 includes a horizontal swim platform 106 attached to the transom 114 to make it easier for people to get into or out of the water. The swim platform is omitted from FIG. 1 for clarity. The swim platform 106 should be capable of supporting a human and is preferably capable of supporting at least 500 lbs., and even more preferably 1250 lbs. The swim platform 106 may be constructed from any suitable material that may be used in a marine environment including, for example, fiberglass or teak. In this embodiment, the swim platform 106 is attached to the transom 114 of the boat 100 using two brackets screwed to the transom 114. However, the swim platform 106 may be attached to the transom 114 by any suitable means. While the swim platform 106 is described as an attachable/detachable platform, it is not so limited. For example, the swim platform 106 may be integrally formed with the stern of the boat 100.

The boat 100 shown in FIG. 1 is a recreational boat and, more specifically, a recreational sport boat that may be used for water sports, such as water skiing, wakeboarding, wake surfing, and wake foiling. The boat 100 thus may be equipped with water sport accessories or systems to facilitate the use of the boat 100 with such activities. These water sport accessories and systems include, for example, devices that interact with the water and are capable enhancing or otherwise adjusting the wake produced by the boat 100 and tow-points and tow-lines for towing water sport participants.

The boat 100 may include the capability to add ballast. Ballast may be used to increase the weight and displacement of the boat 100 and increase the size of the wake for water sports such as wakeboarding or wake surfing. Any suitable means to add ballast may be used, including ballast bags (sacks) or ballast tanks. The boat 100 shown in FIG. 1 includes three ballast tanks. Preferably, two ballast tanks are positioned in the stern of the boat near the bottom of the hull, one on each side of the boat (port ballast tank 142 and a starboard ballast tank 144), and a third ballast tank 146 (see FIG. 10) is positioned along the boat's centerline near the bottom of the hull, forward of the two stern ballast tanks 142, 144. Ballast bags may be used in addition to the ballast tanks 142, 144, 146 and may be plumbed into the ballast system of the boat 100. Preferably, the ballast bags are positioned above the stern ballast tanks 142, 144 in a compartment underneath the aft-facing seats 136. Both the ballast tanks 142, 144, 146 and the ballast bags operate similarly in that water may be pumped into the tank or bag by ballast pumps 148 (see FIG. 16) to add weight.

The boat 100 may be equipped with surf devices 152, 154, which may be used to shape the wake of the boat for wake surfing. Any suitable surf devices may be used, including, for example, the port and starboard wake-modifying devices disclosed in U.S. Pat. No. 8,833,286, which is incorporated by reference herein in its entirety. Each of the port and starboard surf devices 152, 154 includes a plate-like member that is pivotably attached to the transom 114 of the boat 100. The plate-like members pivot about pivot axes to move between a non-deployed position and a deployed position. In this embodiment, the pivot axes are hinges. Here, the hinges are piano hinges that are welded to a leading portion of each plate-like member and attached to the transom 114 of the boat 100 using screws. However, any suitable pivotable connection may be used and may be affixed to the transom 114 of the boat 100 and the port and starboard surf devices 152, 154 using any suitable means, including but not limited to bolts, screws, rivets, welding, and epoxy. Each of the port and starboard surf devices 152, 154 also may include one or more downturned and/or upturned surfaces, such as downturned surfaces at the trailing edge of the plate-like members that are angled at a downward angle relative to the plate-like member. However, as noted above, any suitable surf device may be used and other suitable surf devices may include, for example, the port and starboard wake-modifying devices disclosed in U.S. Pat. No. 9,802,684, which is incorporated by reference herein in its entirety.

As shown in FIG. 1, the boat 100 also is equipped with a central trim device (center tab 156) positioned to span the centerline 102 of the boat. In addition to being used as a trim device to adjust the trim of a boat, the center tab 156 may also be used to modify the wake of the boat 100. For example, the center tab 156 may minimize the wake of the boat 100 to obtain a relatively smooth water surface, which is desirable for water skiing, by lifting the stern of the boat 100. Any suitable trim device may be used, but in this particular embodiment, the center tab 156 is a generally rectangular trim tab that is pivotably attached to the transom 114 of the boat 100. The center tab 156 includes a plate-like member and pivots about a pivot axis to move between a non-deployed position and a deployed position. Like the pivot axes of the surf devices 152, 154, the pivot axis of the center tab 156 may be any suitable pivotable connection affixed to the transom 114 of the boat 100.

Each of the surf devices 152, 154 and the center tab 156 is movable between the deployed position and the non-deployed position by a drive mechanism 158. In the embodiment shown, one drive mechanism 158 is used for each surf device 152, 154 and the center tab 156, allowing them to be operated independently. Each of the drive mechanisms 158 shown in this embodiment is a linear actuator. The linear actuator may be an electric linear actuator, such as one available from Lenco Marine of Stuart, Florida, or an electro-hydraulic actuator, such as one available from Parker Hannifin Corp, of Marysville, Ohio. One end of the linear actuator is connected to the transom 114 of the boat 100 and the other end is connected to the surf device 152, 154 or center tab 156. Any suitable means may be used to move the surf devices 152, 154 and the center tab 156 between the deployed and non-deployed positions, including but not limited to hydraulic linear actuators, gas assist pneumatic actuators, and electrical motors.

The boat 100 also is equipped with an apparatus for towing a water sports participant. As shown in FIGS. 1 and 2, the towing apparatus is a tower 160 that is particularly used for towing a wakeboarder. Any suitable tower 160 may be used, including, for example, those described in U.S. Pat. Nos. 9,580,155, 10,150,540, which are incorporated by reference herein in their entireties. The tower 160 includes two legs: a port leg 162 and a starboard leg 164. The port leg 162 is attached on the port side of the centerline 102 of the boat 100, and the starboard leg 164 is attached on the starboard side of the centerline 102 of the boat 100. Preferably, the port and starboard legs 162, 164 are attached to the port gunwale 122 and to the starboard gunwale 124, respectively. The tower 160 also includes a header 166. The header 166 is connected to an upper portion of each of the two legs 162, 164 and spans the interior 130 of the boat 100 at a height suitable for passengers to pass underneath while standing. In addition, the tower 160 has a tow-line-attachment structure 168 at an upper portion of the tower 160 (the header 166 in this embodiment). This tow-line-attachment structure 168 may be used to connect a tow-line suitable for towing a water sports participant, such as a wakeboarder. Any suitable tow-line-attachment structure may be used, including but not limited to the integrated light and tow-line-attachment assembly disclosed in U.S. Pat. No. 6,539,886, which is incorporated by reference herein in its entirety.

The boat 100 has a deck 170 which includes a floor 172. Passenger seating, such as port and starboard bench seating 182, 184, 186, 188 in both the bow seating area 132 and primary seating area 134, may be constructed on elevated portions (seat support structures 174) of the deck 170. As used herein, these portions are elevated with respect to the level of the floor 172. Other seating locations within the boat's interior 130 include a captain's chair 192 at the control console 126 and a reversible bench seat 194. Although the invention is described with reference to a particular seating arrangement, different seating arrangements are contemplated to be within the scope of the invention.

FIG. 2 is a cross-sectional view, taken along line 2-2 in FIG. 1, of a stern of the boat shown in FIG. 1. As shown in FIG. 2, the boat 100 is an inboard boat having a propulsion system 200. The propulsion system 200 includes a motor, which in this embodiment is a combustion engine 210, configured to drive (rotate) a propeller 220. The engine 210 is connected to the propeller 220 by a drive shaft 230. The engine 210 is located within the interior 130 of the boat 100, and the drive shaft 230 extends through the hull bottom 119. The engine 210 is coupled to the drive shaft to rotate the drive shaft 230 and thus the propeller 220. The drive shaft 230 rotates about a rotation axis 231 of the drive shaft 230. A strut 240 extends from the hull bottom 119 to support the drive shaft 230 and the propeller 220. The drive shaft 230 extends through a bushing in the strut 240. The propeller 220 is positioned beneath the hull bottom 119 and forward of the transom 114. The propulsion system 200 of this embodiment, specifically, the engine 210 and the drive shaft 230, is arranged in V-drive arrangement, allowing the engine 210 to be located further aft in the stern of the boat and further increasing the displacement of the stern of the boat 100 for water sports such as wake surfing or wake boarding. The propulsion system 200 may be arranged in other inboard arrangements such as a direct drive arrangement, which may be preferred for water ski boats where increased displacement is not desired.

A rudder 250 for turning the boat 100 is positioned behind (aft of) the propeller 220. A user may turn the boat 100 by rotating a steering wheel 128 located at the control console 126. The steering wheel 128 is coupled to the rudder 250 such that turning the steering wheel 128 rotates the rudder 250. Any suitable steering system may be used, including mechanical rack-and-pinion systems connected to the rudder by mechanical linkages, hydraulic steering systems, electronic steering systems, or the rudder system shown and described in U.S. Pat. No. 9,611,009, which is incorporated by reference herein in its entirety.

In this embodiment, the engine 210 and the propeller 220 may be operated by a user at the control console 126 (see FIG. 1). The control console 120 may include a control lever 212 that operates a throttle 214 of the engine 210 and engages the engine 210 with the drive shaft 230. The control lever 212 has a neutral position, and the user may move the control lever 212 forward from the neutral position to engage a running gear 216 with the drive shaft 230, accelerate the engine 210 using the throttle 214, and rotate the propeller 220 in a first direction, such as counterclockwise, to drive the boat 100 forward. To move the boat 100 in reverse, the user may move the control lever 212 back from the neutral position to engage a reverse gear 218 with the drive shaft 230, accelerate the engine 210 using the throttle 214, and rotate the propeller 220 in a second direction opposite the first direction, such as clockwise. Any suitable means may be used to operate the engine 210 and engage it with the drive shaft 230.

Figure 3:
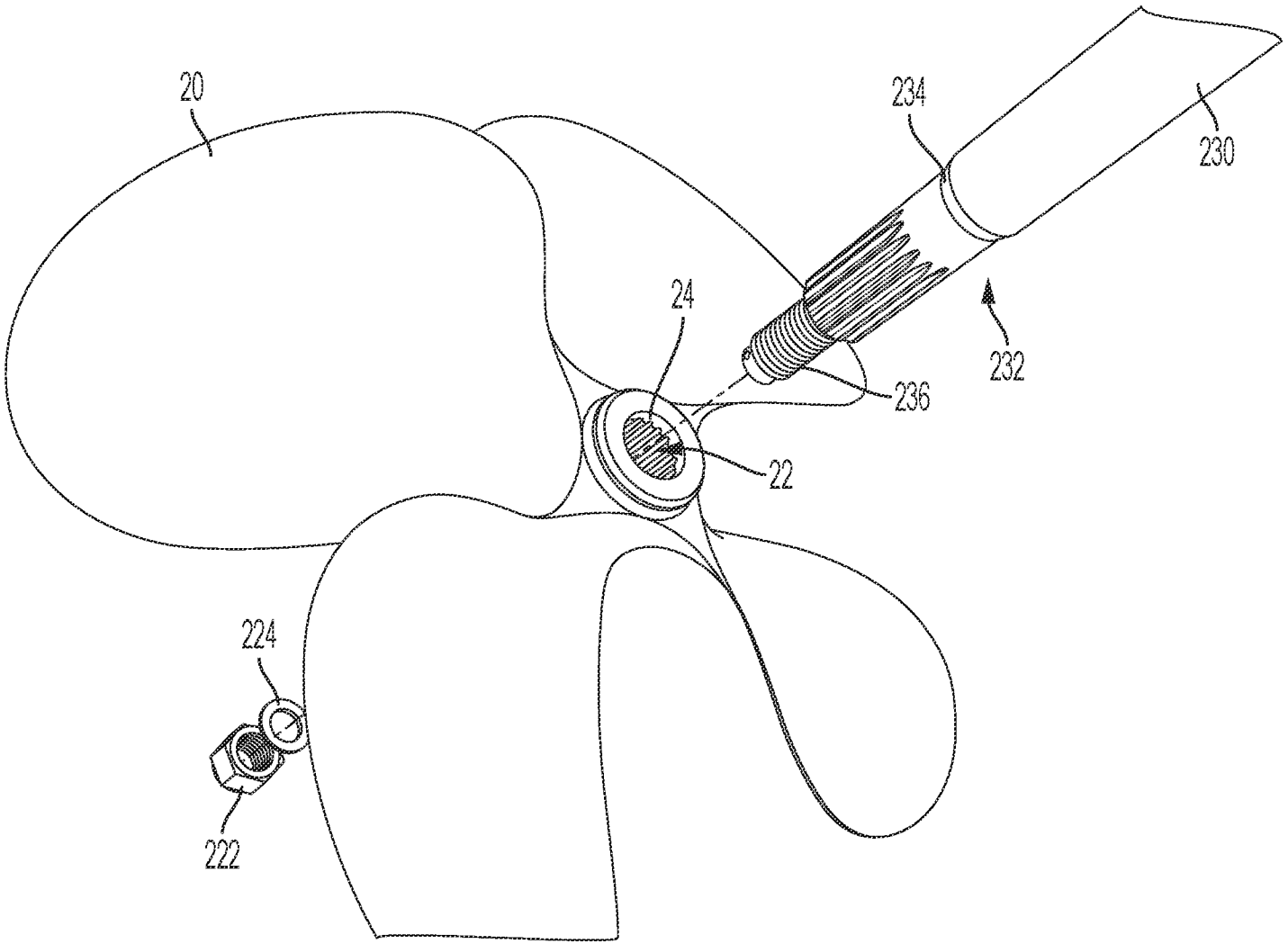
FIG. 3 is an exploded view of a connection of a conventional propeller with a drive shaft.
Figure 4:
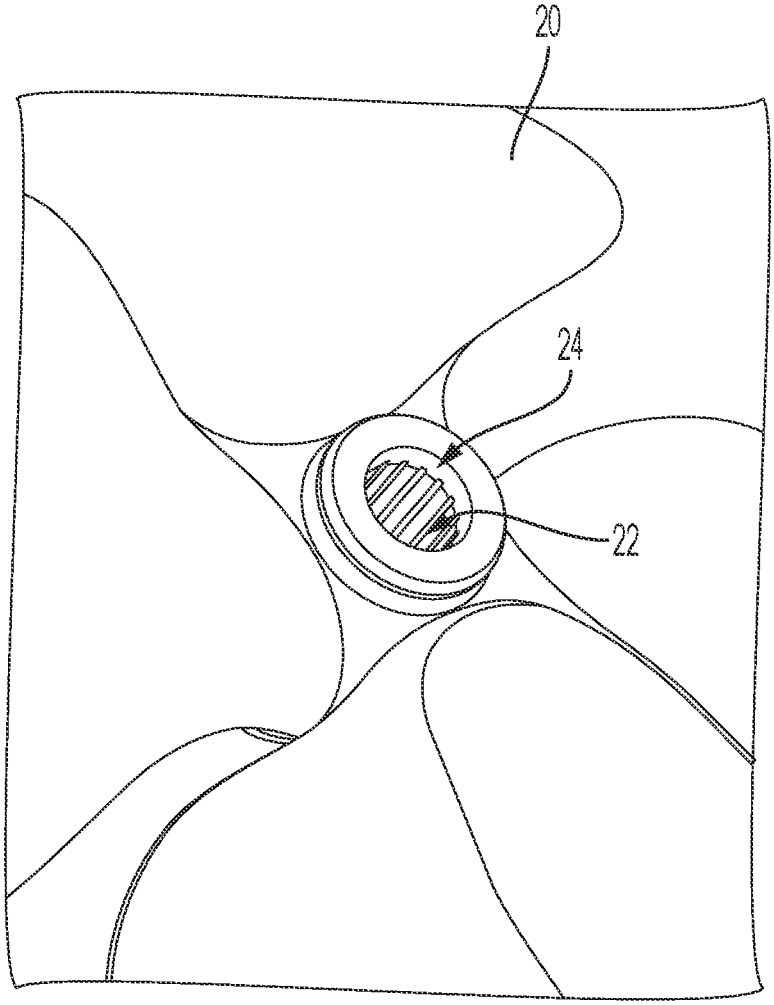
FIG. 4 is a perspective view of the forward side of the conventional propeller shown in FIG. 3.

FIG. 3 is an exploded view of a connection of a conventional propeller 20 with the drive shaft 230, and FIG. 4 is a perspective view of the forward side of the conventional propeller 20. The propeller 20 shown in FIGS. 3 and 4 may be used as the propeller 220 for the boat 100 discussed above. The propeller 20 includes a through-hole 22 through which a propeller end 232 of the drive shaft 230 is inserted. The drive shaft 230 includes a tapered surface 234, and the forward end of the through-hole 22 of the conventional propeller 20 includes a corresponding tapered surface 24. The tapered surface 234 of the drive shaft 230 and the tapered surface 24 of the propeller 20 abut each when the propeller 20 is installed on the drive shaft 230. The propeller end 232 of the drive shaft 230 is threaded (threads 236), and a nut 222 engages with the threads 236 of the drive shaft 230. The nut 222 and an optional washer 224 are used to prevent the propeller 20 from disengaging from the drive shaft 230. A torque may be applied to the nut 222 to seat the propeller 20 tightly on the drive shaft 230, and more specifically to seat the tapered surface 24 of the propeller 20 against the tapered surface 234 of the drive shaft 230.

The inventors have found that with the conventional propeller 20 shown in FIGS. 3 and 4, the propeller 20 becomes worn by the drive shaft 230, causing the propeller 20 to loosen on the drive shaft 230. The loosened propeller 20 can slide forward and contact the strut 240, damaging the propeller 20 and/or the strut 240. In addition, a loose propeller 20 can cause inefficiencies in the performance (e.g., drive) of the propeller 20 and also cause vibrations. An investigation by the inventors has found evidence of wear, particularly on the tapered surface 24 of the propeller 20.

Recreational boats 100, particularly the recreational sport boats such as the one discussed above, are unique in that they can have a high cycle load on the propeller. Such boats 100 frequently stop and start, undergoing rapid accelerations in both the forward and reverse directions. For example, every time a water sports participant falls, the boat 100 is stopped, maneuvered to position the water sports participant for another run, and then rapidly accelerated for the water sport. Without intending to be bound to any theory, such cycle load between the tapered surface 24 of the conventional propeller 20 and the tapered surface 234 of the drive shaft 230 may lead to the observed wear. The conventional propeller 20 is made of a copper or bronze alloy such as NiBrAl (Nickel, Bronze, Aluminum alloy), and the drive shaft 230 is typically made of a harder material suitable for the marine environment, such as a stainless steel alloy.

Figure 5:
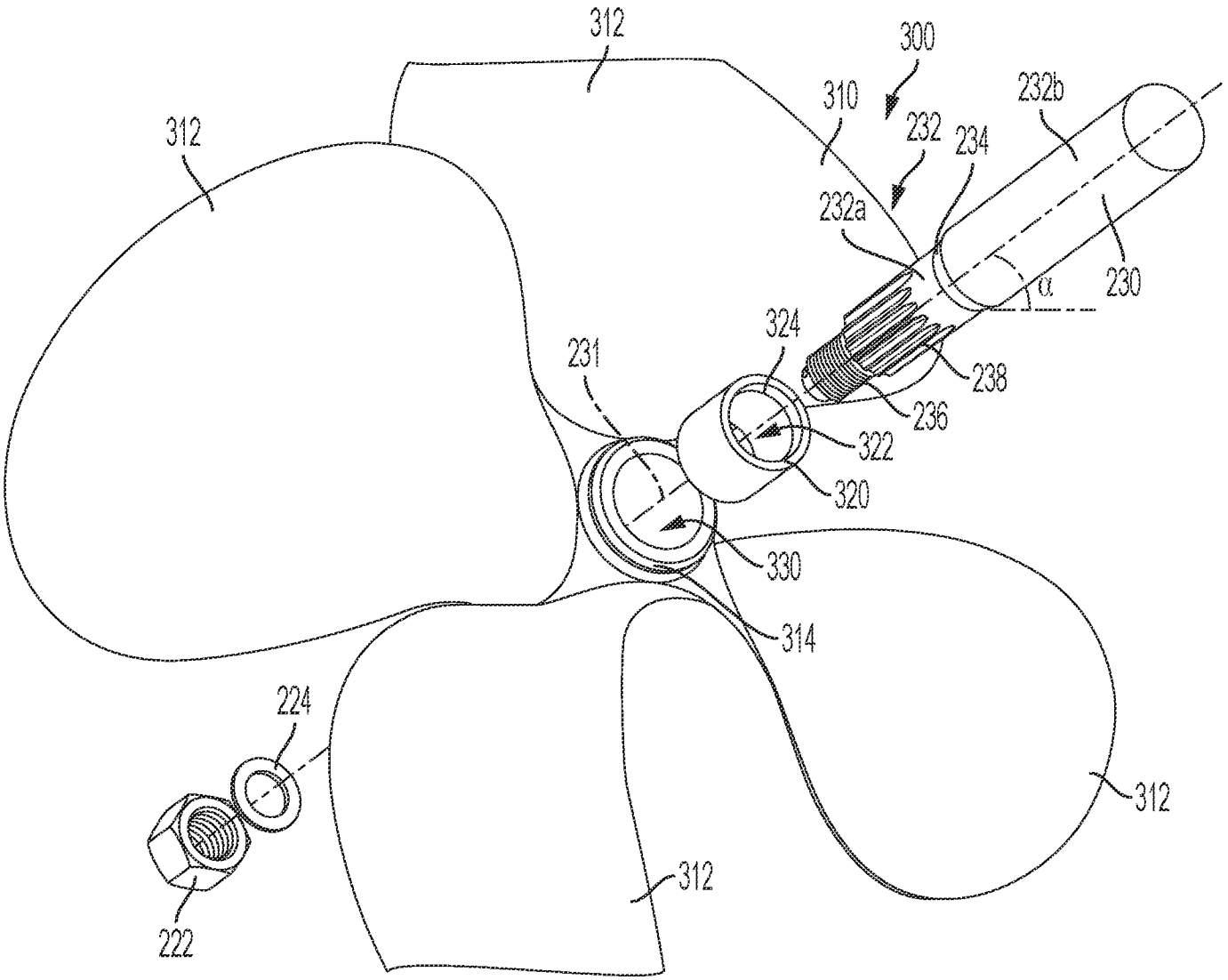
FIG. 5 is an exploded view of a connection of a drive shaft and a propeller assembly according to a preferred embodiment of the invention.
Figure 7:
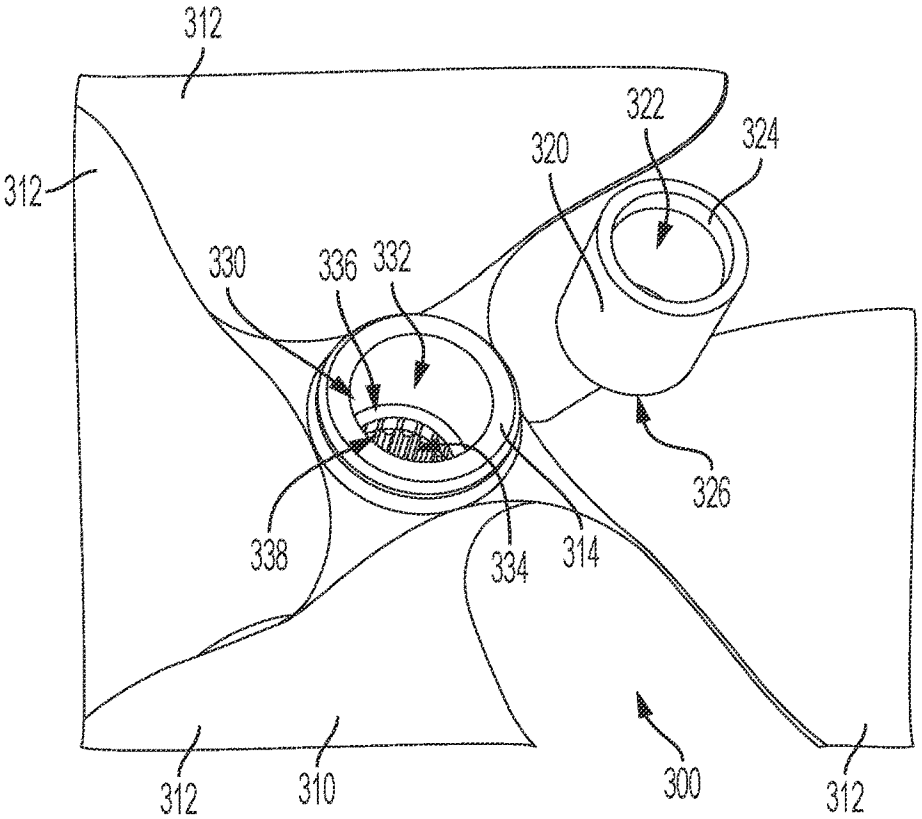
FIG. 7 is a perspective view of the forward side of the propeller assembly shown in FIG. 6 with the thrust bearing removed.
Figure 6:
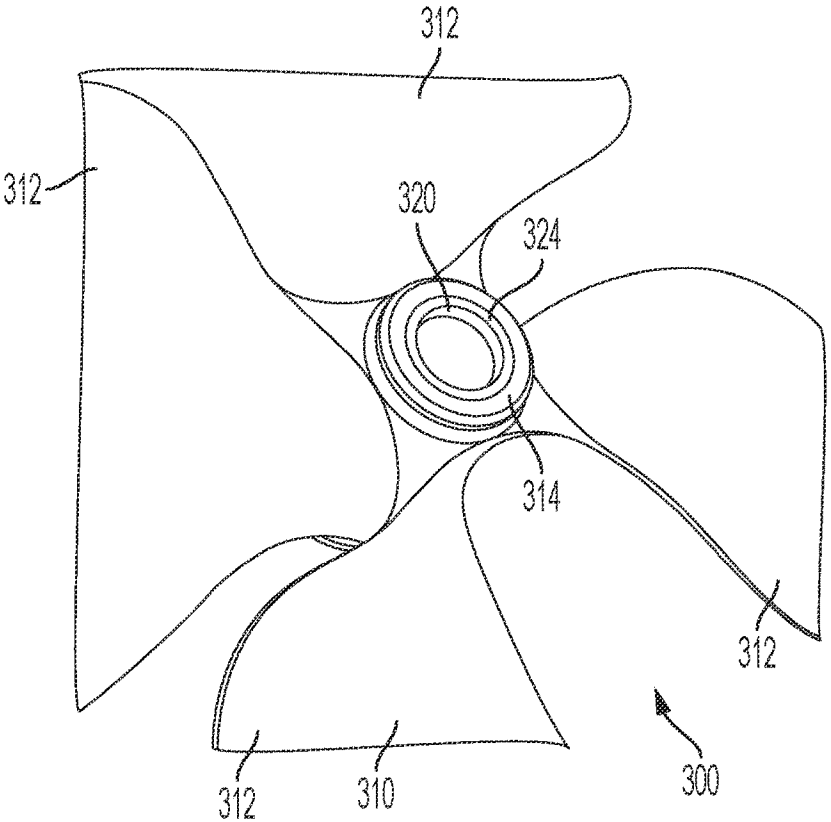
FIG. 6 is a perspective view of the forward side of the propeller assembly shown in FIG. 5 with a thrust bearing of the propeller assembly installed.

To mitigate the aforementioned loosening of the conventional propeller 20, and more specifically wear of the propeller's tapered surface 24, the inventors have developed an improved propeller assembly 300 that may be used as the propeller 220 shown in FIG. 2. FIG. 5 is an exploded view of a connection of the propeller assembly 300 and the drive shaft 230. The propeller assembly 300 includes a propeller 310 and a thrust bearing 320. FIG. 6 is a perspective view of the forward side of the propeller assembly 300 with the thrust bearing 320 installed. FIG. 7 is a perspective view of the forward side of the propeller assembly 300 with the thrust bearing 320 removed. The propeller 310 includes a plurality of blades 312 connected to a central hub 314 with a hole 330 through which the propeller end 232 of the drive shaft 230 is inserted. The thrust bearing 320 is annular, having a central hole 322 therethrough, and the propeller end 232 of the drive shaft 230 is inserted through the central hole 322. In this embodiment, the thrust bearing 320 is a sleeve.

As shown in FIG. 5, the propeller end 232 of the drive shaft 230 of this embodiment includes at least two diameters, a smaller diameter portion 232*a* and a larger diameter portion 232*b*. In this embodiment, the smaller diameter portion 232*a* is aft of the larger diameter portion 232*b*. A transition surface is formed between the smaller diameter portion 232*a* and the larger diameter portion 232*b* and, in the embodiment shown in FIG. 5, is the tapered surface 234. In this embodiment, the tapered surface 234 is frustoconical and expands in a direction away from the propeller end 232 of the drive shaft 230 (a forward direction of the drive shaft 230).

The tapered surface 234 of the drive shaft 230 is configured to receive the resultant force from the propeller 310 when the propeller 310 rotates to propel the boat 100. The tapered surface 234 of the drive shaft 230 is also a mating surface (or a contact surface). This resultant force is transferred from the propeller assembly 300 to the drive shaft 230 by the thrust bearing 320. The thrust bearing 320 also includes a mating surface (or a contact surface) on a forward end of the thrust bearing 320. This mating surface preferably corresponds to the mating surface of the drive shaft 230 and thus, in this embodiment, is also a tapered surface 324. When the propeller assembly 300 is installed on the drive shaft 230, the tapered surface 324 of the thrust bearing 320 abuts the tapered surface 234 of the drive shaft 230.

The tapered surface 234 of the drive shaft 230 is oriented in a direction to receive an axial component of the resultant force, relative to the rotation axis 231 of the drive shaft 230. As noted above, the tapered surface 234 is frustoconical and expands in a forward direction of the drive shaft 230, and the tapered surface 234 of the drive shaft 230 is oriented at an angle $\alpha$ relative to the rotation axis 231 of the drive shaft 230, such that the tapered surface 234 of the drive shaft 230 is oriented in a direction that crosses the rotation axis 231 of the drive shaft 230. In this embodiment, the tapered surface 234 of the drive shaft 230 is tapered in a direction that forms an oblique angle (angle $\alpha$) with the rotation axis 231 of the drive shaft 230. Although shown in this embodiment as the tapered surface 234, the mating surface of the drive shaft 230 may have other suitable orientations, such as being perpendicular to the rotation axis 231 of the drive shaft 230. Similarly, a collar or other component may be used, instead of the mating surface (tapered surface 234) being formed integrally as a single component with the drive shaft 230. As noted above, the tapered surface 324 of the thrust bearing 320 may be a surface that corresponds to and abuts the tapered surface 234 of the drive shaft 230, and thus the tapered surface 324 of the thrust bearing 320 may be orientated in the same manner as the tapered surface 234 of the drive shaft 230, as discussed above. In some embodiments, the tapered surface 324 of the thrust bearing 320 may be at the same angle relative to the rotation axis 231 of the drive shaft 230 as the tapered surface 234 of the drive shaft 230. In this embodiment, the tapered surface 324 of the thrust bearing 320 also is frustoconical and expands in a forward direction of the drive shaft 230.

In this embodiment, the thrust bearing 320 is made of a harder material than the propeller 310. Preferably, the thrust bearing 320 and, more specifically, the tapered surface 324 of the thrust bearing 320 is at least 10 percent harder than the propeller 310, more preferably at least 20 percent harder than the propeller 310, and even more preferably least 25 percent harder than the propeller 310. Hardness measurements may be taken using the appropriate ASTM standard for the hardness measurement technique being employed. Suitable hardness measurement techniques include, for example, Rockwell hardness measurements using an appropriate scale, such as Rockwell hardness scale B or scale C. Stainless steel and other hard materials suitable for use in the marine environment may be used as the material for the thrust bearing 320 to achieve the desired difference in hardness. The harder material for the thrust bearing 320 may reduce wear and thus reduce or eliminate the aforementioned problems associated with loosening of the conventional propeller 20. At the same time, the use of the thrust bearing 320 allows the propeller 310 to be made from a softer material like a copper alloy or bronze alloy, such as NiBrAl.

Although there can large differences between the hardness of the thrust bearing 320 and the drive shaft 230 (e.g., a stainless steel thrust bearing 320 and a titanium drive shaft 230), in some embodiments, the hardness of the thrust bearing 320 and, more specifically, the tapered surface 324 of the thrust bearing 320 is similar to the hardness of the drive shaft 230 and, more specifically, the tapered surface 234 of the drive shaft 230. In such embodiments, the thrust bearing 320 may be made from the same base material as the drive shaft 230. For example, both the thrust bearing 320 and the drive shaft 230 may be formed from steel, but differ in the particular alloy used (e.g., one of the thrust bearing 320 or the drive shaft 230 is made from AQUAMET® 19 and the other made from AQUAMET® 22). In other embodiments, the thrust bearing 320 may be made from the same material as the drive shaft 230. In some embodiments, the hardness of the thrust bearing 320 and, more specifically, the tapered surface 324 of the thrust bearing 320, can be from −20 percent to 20 percent of the hardness of the drive shaft 230 and, more specifically, the tapered surface 234 of the drive shaft 230.

The hole 330 includes a large diameter portion 332 and a small diameter portion 334. The large diameter portion 332 and the small diameter portion 334 are concentric with each other, having a common central axis. The large diameter portion 332 is located on a forward portion of the central hub 314. The thrust bearing 320 is inserted into the propeller 310 and, more specifically, the propeller assembly 300. The large diameter portion 332 of the hole 330 is configured to receive the thrust bearing 320, and the thrust bearing 320 is located in the hole 330 and, more specifically, in the large diameter portion 332 of the hole 330. Preferably, the thrust bearing 320 may be secured in the propeller 310 such that the thrust bearing 320 and the propeller 310 form a unified assembly. As a unified assembly, the thrust bearing 320 moves with the propeller 310 both in terms of rotation and during installation and removal. For example, the thrust bearing 320 can be integrated with the propeller 310 such that the thrust bearing 320 stays with the propeller 310 when the propeller assembly 300 is removed from the drive shaft 230. The thrust bearing 320 may be secured in the propeller 310 and, more specifically, in the large diameter portion 332, by any suitable means to form the unified assembly. In this embodiment, the thrust bearing 320 is press fit into the propeller 310. As noted above, the thrust bearing 320 is a sleeve and an outer circumferential surface of the thrust bearing 320 is in contact with an inner circumferential surface of the large diameter portion 332. The thrust bearing 320 may also be mechanically bonded to the propeller 310. For example, the thrust bearing 320 may be bonded to the propeller 310 by an adhesive, such as Loctite, or the thrust bearing 320 may be braised or soldered to the propeller 310.

A surface formed at an aft end of the large diameter portion 332 where the large diameter portion 332 transitions to the small diameter portion 334 is a mating surface 336 of the propeller 310. The mating surface 336 is an internal surface of the propeller 310. The thrust bearing 320 also includes a mating surface 326. The mating surface 326 of the thrust bearing 320 is the aft end surface or propeller end surface of the thrust bearing 320. The mating surface 326 is formed on an end of the thrust bearing 320 that is opposite the end of the thrust bearing 320 on which the tapered surface 324 is formed. The thrust bearing 320 is positioned within the hole 330 of the propeller 310 such that the mating surface 326 of the thrust bearing 320 abuts the mating surface 336 of the propeller 310. The mating surface 336 of the propeller 310 can have a larger area than a contact surface (tapered surface 324) of the thrust bearing 320 with the drive shaft 230, reducing the likelihood of wear between the propeller 310 and the thrust bearing 320. In addition, the matting surface 336 of the propeller 310 may have a more perpendicular face than the contact surface (tapered surface 324) of the thrust bearing 320 with the drive shaft 230, resulting in a better transfer of load to the thrust bearing 320 and reducing the likelihood of wear between the propeller 310 and the thrust bearing 320.

In the embodiments shown herein, splines 338 are formed on the propeller 310 and, more specifically, on an internal surface of the small diameter portion 334. Splines 238 also are formed on the drive shaft 230, more specifically, on the propeller end 232 of the drive shaft 230 and, even more specifically, on the smaller diameter portion 232*a* between the threads 236 and the tapered surface 234. The splines 338 of the propeller 310 engage with the splines 238 of the drive shaft 230 to transmit the rotational torque from the drive shaft 230 to the propeller 310. However, the propeller 310 and the drive shaft 230 may engage with each other in other suitable ways, such as, for example, a key located in a keyway (groove) formed in each of the propeller 310 and the drive shaft 230.

With the thrust bearing 320 engaged with the propeller 310, the drive shaft 230 is inserted through the hole 322 of the thrust bearing 320 and the hole 330 of the propeller 310. The splines 338 of the propeller 310 and the splines 238 of the drive shaft 230 are engaged with each other. The drive shaft 230 and, more specifically, the threaded portion (threads 236) of the drive shaft 230, protrude from an aft side of the propeller 310, and the nut 222 engages with the threads 236 of the drive shaft 230. The nut 222 is used to prevent the propeller assembly 300 from disengaging from the drive shaft 230. An optional washer 224 may be placed between the nut 222 and the propeller 310. A torque may be applied to the nut 222 to seat propeller assembly 300 tightly on the drive shaft 230, and more specifically to seat the tapered surface 324 of the thrust bearing 320 against the taper 234 of the drive shaft 230.

Although this invention has been described with respect to certain specific exemplary embodiments, many additional modifications and variations will be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

What is claimed is:

1. A boat comprising:

a hull including a transom and a hull bottom;

a drive shaft extending through the hull bottom;

a motor positioned within the hull and configured to rotate the drive shaft; and a propeller assembly positioned forward of the transom and beneath the hull bottom, the propeller assembly including:

a propeller having a central hub and a plurality of blades connected to the central hub, the central hub including a hole into which a propeller end of the drive shaft is inserted; and a thrust bearing including an outer circumferential surface, the thrust bearing being received within the hole of the central hub such that at least a portion of the outer circumferential surface is located in the hole, the thrust bearing being made of a harder material than the propeller.

2. The boat of claim 1, wherein the hull is a planing hull.

3. The boat of claim 1, wherein the thrust bearing is secured in the hole of the central hub by being press fit into the hole.

4. The boat of claim 1, wherein the hole of the central hub includes a large diameter portion and a small diameter portion, the thrust bearing being located in the large diameter portion of the hole.

5. The boat of claim 4, wherein the hole includes a mating surface, the mating surface of the propeller being a surface formed at an end of the large diameter portion where the large diameter portion transitions to the small diameter portion, and wherein the thrust bearing includes a mating surface, the thrust bearing being positioned within the hole of the central hub such that the mating surface of the thrust bearing abuts the mating surface of the propeller.

6. The boat of claim 5, wherein the thrust bearing includes a contact surface formed on the thrust bearing and configured to contact a contact surface of the drive shaft, the surface area of the mating surface of the thrust bearing being larger than the surface area of the contact surface of the thrust bearing.

7. The boat of claim 1, wherein the drive shaft includes a contact surface, the thrust bearing includes a contact surface, and the propeller assembly is connected to the drive shaft such that the contact surface of the thrust bearing abuts the contact surface of the drive shaft.

8. The boat of claim 7, wherein the contact surface of the drive shaft is a tapered surface, and the contact surface of the thrust bearing is a tapered surface.

9. The boat of claim 8, wherein the tapered surface of the drive shaft and the tapered surface of the thrust bearing are each tapered to expand in a forward direction of the drive shaft.

10. The boat of claim 8, wherein the drive shaft is configured to rotate about a rotation axis, and wherein the tapered surface of the drive shaft and the tapered surface of the thrust bearing are oriented at the same angle relative to the rotation axis of the drive shaft.

11. The boat of claim 1, wherein the propeller is a copper alloy.

12. The boat of claim 1, wherein the thrust bearing is stainless steel.

13. The boat of claim 1, wherein the thrust bearing is made from the same base material as the drive shaft.

14. The boat of claim 1, wherein the thrust bearing is located entirely within the hole of the central hub.

15. The boat of claim 1, wherein the hole includes an inner circumferential surface, and the outer circumferential surface of the thrust bearing is in contact with the inner circumferential surface.

16. The boat of claim 1, wherein the thrust bearing is annular, having a hole therethrough, and the drive shaft extends through the hole of the thrust bearing.

17. The boat of claim 14, wherein the thrust bearing is a sleeve.

18. The boat of claim 4, wherein the small diameter portion includes internal surface with splines formed thereon, and wherein the drive shaft includes splines formed thereon, the splines of the propeller engaging with the splines of the drive shaft to transmit the rotational torque from the drive shaft to the propeller.

19. The boat of claim 7, wherein the contact surface of the thrust bearing has a hardness that is from −20 percent to 20 percent of the hardness of the contact surface of the drive shaft.

20. The boat of claim 1, wherein the thrust bearing has a hardness that is at least 25 percent harder than the propeller.

* * * * *